US012252828B2

(12) United States Patent
Rajendran

(10) Patent No.: US 12,252,828 B2
(45) Date of Patent: Mar. 18, 2025

(54) COMBINATION WASHING AND DRYING LAUNDRY TREATING APPLIANCE

(71) Applicant: WHIRLPOOL CORPORATION, Benton Harbor, MI (US)

(72) Inventor: Arun Rajendran, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 274 days.

(21) Appl. No.: 17/876,117

(22) Filed: Jul. 28, 2022

(65) Prior Publication Data

US 2024/0035218 A1 Feb. 1, 2024

(51) Int. Cl.

| | |
|---|---|
| ***D06F 25/00*** | (2006.01) |
| ***D06F 33/52*** | (2020.01) |
| ***D06F 39/04*** | (2006.01) |
| ***D06F 58/26*** | (2006.01) |
| *D06F 105/28* | (2020.01) |

(52) U.S. Cl.

CPC ..... *D06F 25/00* (2013.01); *D06F 33/52* (2020.02); *D06F 39/04* (2013.01); *D06F 58/26* (2013.01); *D06F 2105/28* (2020.02)

(58) Field of Classification Search

None

See application file for complete search history.

(56) References Cited

U.S. PATENT DOCUMENTS

| | | | |
|---|---|---|---|
| 6,966,124 | B2 | 11/2005 | Ryu |
| 7,017,280 | B2 | 3/2006 | Green et al. |
| 8,356,423 | B2 | 1/2013 | Corberan Salvador et al. |
| 10,738,411 | B2 * | 8/2020 | Civanelli ..... D06F 58/206 |
| 11,008,697 | B2 | 5/2021 | Masters |
| 2010/0263225 | A1 | 10/2010 | Balerdi Azpilicueta et al. |

FOREIGN PATENT DOCUMENTS

| | | | |
|---|---|---|---|
| KR | 100393570 | B1 | 8/2003 |

* cited by examiner

*Primary Examiner* — Rita P Adhlakha

(74) *Attorney, Agent, or Firm* — Brooks Kushman P.C.

(57) ABSTRACT

A laundry machine washer-dryer combination includes a cabinet, a drum, a heater, an air duct, a container, and a fluid loop. The cabinet defines an internal chamber. The drum is disposed in the internal chamber and is configured to receive clothing articles. The heater is disposed in the internal chamber and is configured to heat air flowing to the drum during a drying cycle. The air duct is disposed in the internal chamber and is configured direct air from the drum to the heater during the drying cycle. The container is disposed in the internal chamber and has an energy storage material disposed therein. The fluid loop is configured to transfer heat from the air flowing through the air duct to the energy storage material during the drying cycle.

20 Claims, 3 Drawing Sheets

COMBINATION WASHING AND DRYING LAUNDRY TREATING APPLIANCE

TECHNICAL FIELD

The present disclosure generally relates to laundry treating appliances such as a laundry dryers or washing machines.

BACKGROUND

Combination washing and drying machines are configured to both wash and dry clothing articles.

SUMMARY

A laundry machine washer-dryer combination includes a cabinet, a drum, a heater, an air duct, a container, and a fluid loop. The cabinet defines an internal chamber. The drum is disposed in the internal chamber and is configured to receive clothing articles. The heater is disposed in the internal chamber and is configured to heat air flowing to the drum during a drying cycle. The air duct is disposed in the internal chamber and is configured direct air from the drum to the heater during the drying cycle. The container is disposed in the internal chamber and has an energy storage material disposed therein. The fluid loop is configured to transfer heat from the air flowing through the air duct to the energy storage material during the drying cycle.

A laundry machine includes a drum, a heater, an air duct, and a fluid circuit. The drum is configured to receive clothing articles. The heater is configured to heat air flowing to the drum. The air duct is configured direct air from the drum to the heater. The fluid circuit is configured to transfer heat from the air flowing through the air duct to an energy storage material.

A laundry machine includes a cabinet, a heater, an air duct, a heat storing material, and a fluid circuit. The cabinet defines a clothing treating chamber. The heater is configured to heat air flowing to the clothing treating chamber. The air duct is configured direct air from the clothing treating chamber to the heater. The heat storing material is disposed within the cabinet. The fluid circuit is configured to transfer heat from the air flowing through the air duct to the heat storing material.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
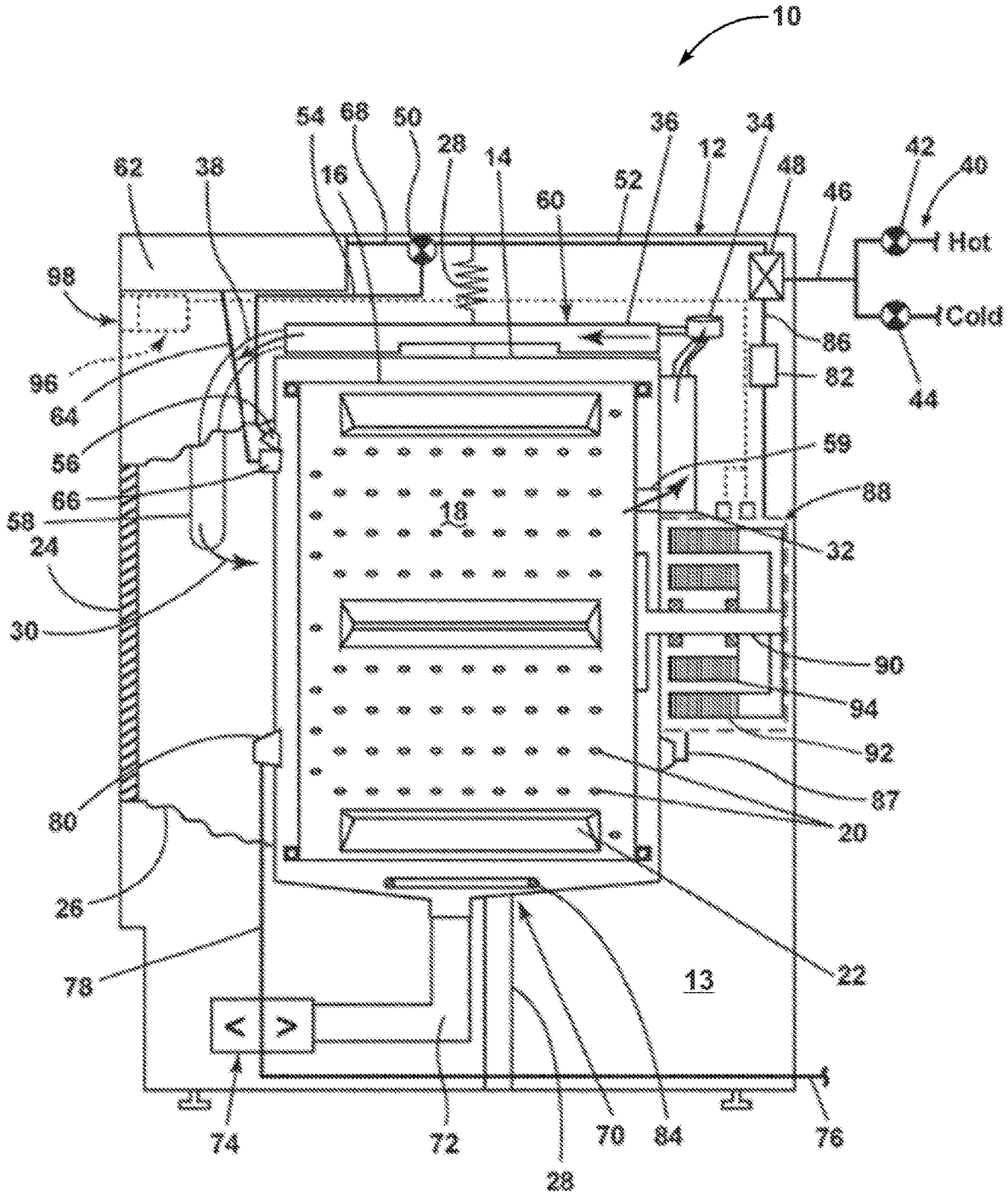
FIG. 1 illustrates a schematic cross-sectional view of a laundry treating appliance including a drying air circuit.

FIG. 1 is a schematic cross-sectional view of a laundry machine or laundry treating appliance 10 according to an aspect of the present disclosure. The laundry treating appliance 10 can be any laundry treating appliance 10 which performs a cycle of operation to clean or otherwise treat laundry items placed therein, non-limiting examples of which include a horizontal or vertical axis clothes washer; a horizontal or vertical axis clothes dryer; a combination washing machine and dryer; a tumbling or stationary refreshing/revitalizing machine; an extractor; a non-aqueous washing apparatus; and a revitalizing machine. While the laundry treating appliance 10 is illustrated herein as a horizontal axis, front-load laundry treating appliance 10, the aspects of the present disclosure can have applicability in laundry treating appliances with other configurations. The laundry treating appliance 10 shares many features of a conventional automated clothes washer and/or dryer, which will not be described in detail herein except as necessary for a complete understanding of the exemplary aspects in accordance with the present disclosure.

Laundry treating appliances are typically categorized as either a vertical axis laundry treating appliance or a horizontal axis laundry treating appliance. As used herein, the term "horizontal axis" laundry treating appliance refers to a laundry treating appliance having a rotatable drum that rotates about a generally horizontal axis relative to a surface that supports the laundry treating appliance. The drum can rotate about the axis inclined relative to the horizontal axis, with fifteen degrees of inclination being one example of the inclination. Similar to the horizontal axis laundry treating appliance, the term "vertical axis" laundry treating appliance refers to a laundry treating appliance having a rotatable drum that rotates about a generally vertical axis relative to a surface that supports the laundry treating appliance. However, the rotational axis need not be perfectly vertical to the surface. The drum can rotate about an axis inclined relative to the vertical axis, with fifteen degrees of inclination being one example of the inclination.

In another aspect, the terms vertical axis and horizontal axis are often used as shorthand terms for the manner in which the appliance imparts mechanical energy to the laundry, even when the relevant rotational axis is not absolutely vertical or horizontal. As used herein, the "vertical axis" laundry treating appliance refers to a laundry treating appliance having a rotatable drum, perforate or imperforate, that holds fabric items and, optionally, a clothes mover, such as an agitator, impeller, nutator, and the like within the drum. The clothes mover can move within the drum to impart mechanical energy directly to the clothes or indirectly through wash liquid in the drum. The clothes mover can typically be moved in a reciprocating rotational movement. In some vertical axis laundry treating appliances, the drum rotates about a vertical axis generally perpendicular to a surface that supports the laundry treating appliance. However, the rotational axis need not be vertical. The drum can rotate about an axis inclined relative to the vertical axis.

As used herein, the "horizontal axis" laundry treating appliance refers to a laundry treating appliance having a rotatable drum, perforated or imperforate, that holds laundry items and washes and/or dries the laundry items. In some horizontal axis laundry treating appliances, the drum rotates about a horizontal axis generally parallel to a surface that supports the laundry treating appliance. However, the rotational axis need not be horizontal. The drum can rotate about an axis inclined or declined relative to the horizontal axis. In horizontal axis laundry treating appliances, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines may be differentiated by the manner in which they impart mechanical energy to the fabric articles.

Regardless of the axis of rotation, a laundry treating appliance can be top-loading or front-loading. In a top-loading laundry treating appliance, laundry items are placed into the drum through an access opening in the top of a cabinet, while in a front-loading laundry treating appliance laundry items are placed into the drum through an access opening in the front of a cabinet. If a laundry treating appliance is a top-loading horizontal axis laundry treating appliance or a front-loading vertical axis laundry treating appliance, an additional access opening is located on the drum.

In more detail, the laundry treating appliance 10 is illustrated as a horizontal axis combination washing and drying laundry treating appliance 10, though it will be understood that the laundry treating appliance 10 need not be a combination washing and drying laundry treating appliance 10, but that any suitable laundry treating appliance 10 for drying laundry items can be provided, including a clothes dryer. The laundry treating appliance 10 can include a structural support assembly comprising a cabinet 12 which defines an internal cavity or chamber 13 within which a laundry holding assembly resides. The cabinet 12 can be a housing having a chassis and/or a frame, to which decorative panels can or cannot be mounted, defining an interior, enclosing components typically found in a conventional laundry treating appliance, such as motors, pumps, fluid lines, controls, sensors, transducers, and the like.

The laundry holding assembly of the illustrated laundry treating appliance 10 can include a tub 14 dynamically suspended within the structural support assembly of the cabinet 12 by a suitable suspension assembly 28, the tub 14 at least partially defining a laundry treating chamber 18 for laundry items. A rotatable drum 16 can be provided within the tub 14 to further define at least a portion of the laundry treating chamber 18. It is noted that the tub 14 and the drum 16 are disposed within the internal chamber 13, and that the laundry treating chamber 18 is therefore defined within the cabinet 12. The treating chamber 18 is configured to receive a laundry load comprising articles for treatment, including, but not limited to, a hat, a scarf, a glove, a sweater, a blouse, a shirt, a pair of shorts, a dress, a sock, and a pair of pants, a shoe, an undergarment, a jacket, and other clothing articles.

The drum 16 can include a plurality of perforations 20 such that liquid can flow between the tub 14 and the drum 16 through the perforations 20. A plurality of baffles 22 can be disposed on an inner surface of the drum 16 to lift the laundry load received in the treating chamber 18 while the drum 16 rotates. It is also within the scope of the present disclosure for the laundry holding assembly to comprise only one receptacle, such as the tub 14 without the drum 16, or the drum 16 without the tub 14, with the single receptacle defining the laundry treating chamber 18 for receiving the load to be treated.

The laundry holding assembly can further include a closure, illustrated herein as a door assembly 24, which can be movably mounted to or coupled to the cabinet 12 to selectively close both the tub 14 and the drum 16, as well as the treating chamber 18. In one example, the door assembly 24 can be rotatable relative to the cabinet 12. By way of non-limiting example, the door assembly 24 can be hingedly coupled to the cabinet 12 for movement between an opened condition (not shown) and a closed condition as shown.

A bellows 26 can extend between the tub 14 and the cabinet 12 to couple an open face of the tub 14 with the cabinet 12, with the door assembly 24 sealing against the bellows 26 or the cabinet 12, or both, when the door assembly 24 closes the tub 14. In the opened condition, the door assembly 24 can be spaced apart from the bellows 26 and can allow access to the treating chamber 18. The bellows 26 can sealingly couple the open face of the tub 14 with the cabinet 12 such that liquid is not permitted to move from the tub 14 into the interior of the cabinet 12.

The laundry treating appliance 10 can optionally further comprise a washing circuit which can include a liquid supply assembly for supplying liquid, such as water or a combination of water and one or more wash aids, such as detergent, to the laundry treating appliance 10 for use in treating laundry during a cycle of operation. The liquid supply assembly can include a source of water, such as a household water supply 40, which can include separate valves 42 and 44 for controlling the flow of hot and cold water, respectively. The valves 42, 44 can be opened individually or together to provide a mix of hot and cold water at a selected temperature. The valves 42, 44 are selectively openable to provide water, such as from the household water supply 40, to be supplied through an inlet conduit 46 directly to the tub 14 or the drum 16 by controlling first and second diverter mechanisms 48 and 50, respectively. The diverter mechanisms 48, 50 can each be a diverter valve having two outlets such that each of the diverter mechanisms 48, 50 can selectively direct a flow of liquid to one or both of two flow paths. Water from the household water supply 40 can flow through the inlet conduit 46 to the first diverter mechanism 48 which can direct the flow of liquid to a supply conduit 52. The second diverter mechanism 50 on the supply conduit 52 can direct the flow of liquid to a tub outlet conduit 54 which can be provided with a spray nozzle 56 configured to spray the flow of liquid into the tub 14 in a desired pattern and under a desired amount of pressure. For example, the spray nozzle 56 can be configured to dispense a flow or stream of water into the tub 14 by gravity, i.e. a non-pressurized stream. In this manner, water from the household water supply 40 can be supplied directly to the tub 14. While the valves 42, 44 and the conduit 46 are illustrated exteriorly of the cabinet 12, it will be understood that these components can be internal to the cabinet 12.

The laundry treating appliance 10 can also optionally be provided with a dispensing assembly for dispensing treating chemistry to the treating chamber 18 for use in treating the laundry according to a cycle of operation. The dispensing assembly can include a treating chemistry dispenser 62 which can be a single dose dispenser, a bulk dispenser, or an integrated single dose and bulk dispenser and is fluidly coupled to the treating chamber 18. The treating chemistry dispenser 62 can be configured to dispense a treating chemistry directly to the tub 14 or mixed with water from the liquid supply assembly through a dispensing outlet conduit 64. The treating chemistry dispenser 62 can include means for supplying or mixing detergent to or with water from the water supply 40. Alternatively or additionally, water from the water supply 40 can also be supplied to the tub 14 through the treating chemistry dispenser 62 without the addition of a detergent. The dispensing outlet conduit 64 can include a dispensing nozzle 66 configured to dispense the treating chemistry into the tub 14 in a desired pattern and under a desired amount of pressure. For example, the dispensing nozzle 66 can be configured to dispense a flow or stream of treating chemistry into the tub 14 by gravity, i.e. a non-pressurized stream. Water can be supplied to the treating chemistry dispenser 62 from the supply conduit 52 by directing the diverter mechanism 50 to direct the flow of water to a dispensing supply conduit 68.

The treating chemistry dispenser 62 can include multiple chambers or reservoirs for receiving doses of different treating chemistries. The treating chemistry dispenser 62 can be implemented as a dispensing drawer that is slidably received within the cabinet 12, or within a separate dispenser housing which can be provided in the cabinet 12. The treating chemistry dispenser 62 can be moveable between a fill position, where the treating chemistry dispenser 62 is exterior to the cabinet 12 and can be filled with treating chemistry, and a dispense position, where the treating chemistry dispenser 62 are interior of the cabinet 12.

Non-limiting examples of treating chemistries that can be dispensed by the dispensing assembly during a cycle of operation include one or more of the following: water, detergents, surfactants, enzymes, fragrances, stiffness/sizing agents, wrinkle releasers/reducers, softeners, antistatic or electrostatic agents, stain repellents, water repellents, energy reduction/extraction aids, antibacterial agents, medicinal agents, vitamins, moisturizers, shrinkage inhibitors, and color fidelity agents, and combinations thereof. The treating chemistries can be in the form of a liquid, powder, or any other suitable phase or state of matter.

The laundry treating appliance 10 can also include a recirculation and drain assembly for recirculating liquid within the laundry holding assembly and draining liquid from the laundry treating appliance 10. Liquid supplied to the tub 14 through tub outlet conduit 54 and/or the dispensing supply conduit 68 typically enters a space between the tub 14 and the drum 16 and can flow by gravity to a sump 70 formed in part by a lower portion of the tub 14. The sump 70 can also be formed by a sump conduit 72 that can fluidly couple the lower portion of the tub 14 to a pump 74. The pump 74 can have an inlet fluidly coupled with the sump 70 and an outlet configured to fluidly couple and to direct liquid to a drain conduit 76, which can drain the liquid from the laundry treating appliance 10, or to a recirculation conduit 78, which can terminate at a recirculation inlet 80. In this configuration, the pump 74 can be used to drain or recirculate wash water in the sump 70. The recirculation inlet 80 can direct the liquid from the recirculation conduit 78 into the drum 16 by fluidly coupling the recirculation conduit 78 with the drum 16. The recirculation inlet 80 can introduce the liquid into the drum 16 in any suitable manner, such as by spraying, dripping, or providing a steady flow of liquid. In this manner, liquid provided to the tub 14, with or without treating chemistry, can be recirculated into the treating chamber 18 for treating the laundry within. The recirculation and drain assembly can include other types of recirculation systems.

The liquid supply and/or recirculation and drain assembly can be provided with a heating assembly which can include one or more devices for heating laundry and/or liquid supplied to the tub 14, such as a steam generator 82 and/or a sump heater 84. Liquid from the household water supply 40 can be provided to the steam generator 82 through the inlet conduit 46 by controlling the first diverter mechanism 48 to direct the flow of liquid to a steam supply conduit 86. Steam generated by the steam generator 82 can be supplied to the tub 14 through a steam outlet conduit 87. The steam generator 82 can be any suitable type of steam generator such as a flow through steam generator or a tank-type steam generator. Alternatively, the sump heater 84 can be used to generate steam in place of or in addition to the steam generator 82. In addition or alternatively to generating steam, the steam generator 82 and/or sump heater 84 can be used to heat the laundry and/or liquid within the tub 14 as part of a cycle of operation. The sump heater 84 can be provided within the sump 70 to heat liquid that collects in the sump 70. Alternatively, the heating assembly can include an in-line heater that heats the liquid as it flows through the liquid supply, dispensing, and/or recirculation assemblies.

It is noted that the illustrated suspension assembly, liquid supply assembly, recirculation and drain assembly, and dispensing assembly are shown for exemplary purposes only and are not limited to the assemblies shown in the drawings and described above. For example, the liquid supply, dispensing, and recirculation and pump assemblies can differ from the configuration shown in FIG. 1, such as by inclusion of other valves, conduits, treating chemistry dispensers, heaters, sensors (such as water level sensors and temperature sensors), and the like, to control the flow of liquid through the laundry treating appliance 10 and for the introduction of more than one type of treating chemistry. For example, the liquid supply assembly can include a single valve for controlling the flow of water from the household water source. In another example, the recirculation and pump assembly can include two separate pumps for recirculation and draining, instead of the single pump as previously described. In yet another example, the liquid supply assembly can be configured to supply liquid into the interior of the drum 16 or into the interior of the tub 14 not occupied by the drum 16, such that liquid can be supplied directly to the tub 14 without having to travel through the drum 16.

The laundry treating appliance 10 also includes a drive assembly for rotating the drum 16 within the tub 14. The drive assembly can include a motor 88, which can be directly coupled with the drum 16 through a drive shaft 90 to rotate the drum 16 about a rotational axis during a cycle of operation. The motor 88 can be a brushless permanent magnet (BPM) motor having a stator 92 and a rotor 94. Alternately, the motor 88 can be coupled to the drum 16 through a belt and a drive shaft to rotate the drum 16, as is known in the art. Other motors, such as an induction motor or a permanent split capacitor (PSC) motor, can also be used.

The motor 88 can rotationally drive the drum 16, including that the motor 88 can rotate the drum 16 at various speeds in either rotational direction. In particular, the motor 88 can rotate the drum 16 at tumbling speeds wherein the laundry items in the drum 16 rotate with the drum 16 from a lowest location of the drum 16 towards a highest location of the drum 16, but fall back to the lowest location of the drum 16 before reaching the highest location of the drum 16. The rotation of the laundry items with the drum 16 can be facilitated by the baffles 22. Typically, the force applied to the laundry items at the tumbling speeds is less than about 1G. Alternatively, the motor 88 can rotate the drum 16 at spin speeds wherein the laundry items rotate with the drum 16 without falling. The spin speeds can also be referred to as satellizing speeds or sticking speeds. Typically, the force applied to the laundry items at the spin speeds is greater than or about equal to 1G. As used herein, "tumbling" of the drum 16 refers to rotating the drum 16 at a tumble speed, "spinning" the drum 16 refers to rotating the drum 16 at a spin speed, and "rotating" of the drum 16 refers to rotating the drum 16 at any speed.

The laundry treating appliance 10 can further comprise a drying air circuit 60 fluidly coupled to the treating chamber 18 for drying laundry items. The drying air circuit 60 can be a closed loop circuit or an open loop circuit. The drying air circuit 60 can comprise a treating chamber air inlet 58 and a treating chamber air outlet 59, and specifically can be fluidly coupled with the treating chamber air inlet 58 and the treating chamber air outlet 59 and configured to supply drying air through the treating chamber 18 from the treating chamber air inlet 58 to the treating chamber air outlet 59. The treating chamber 18 may be considered to be a part of the drying air circuit 60. While the treating chamber air inlet 58 is illustrated herein as being provided on the bellows 26, it will be understood that the treating chamber air inlet 58 can be any provided at any suitable position of the treating chamber 18, including as an opening in at least one of the drum 16 or the tub 14. The treating chamber air outlet 59 is illustrated herein as being provided at a rear wall of the tub 14, the drum 16, and the treating chamber 18, though such a position is not limiting. The treating chamber air inlet 58 and the treating chamber air outlet 59 can be provided at any suitable locations of the treating chamber 18 so long as they are spaced from one another to allow drying air to flow through the treating chamber 18.

In one example, the drying air circuit 60 can be provided as a closed loop, or recirculating, drying air circuit 60, as illustrated herein. The closed loop drying air circuit 60 can define a drying air flow pathway, as indicated by the arrows 30, to recirculate air through the treating chamber 18. The closed loop drying air circuit 60 can include a condenser 32, a blower 34, a heating portion 36, and a drying air conduit 38. The condenser 32 can be provided with a condenser drain conduit (not shown) that fluidly couples the condenser 32 with the pump 74 and the drain conduit 76. Condensed liquid collected within the condenser 32 can flow through the condenser drain conduit to the pump 74, where it can be provided to the recirculation and drain assembly. The blower 34 is fluidly coupled to the treating chamber 18 such that actuation of the blower 34 supplies or circulates air through the treating chamber 18 by flowing air from the treating chamber air inlet 58 to the treating chamber air outlet 59. The heating portion 36 can enclose at least one heater or heating element (not shown) that is configured to heat recirculating air that flows through the drying air circuit 60. In one example, the drying air circuit 60 can be provided adjacent an upper portion of the tub 14, though it will be understood that the drying air circuit 60 need not be provided adjacent the upper portion of the tub 14, and can be provided at any suitable location adjacent the tub 14 or the treating chamber 18.

In one example, the drying air flow pathway 30 can pass through the components of the closed loop drying air circuit 60 such that air exiting the treating chamber 18 through the treating chamber air outlet 59 flows through the condenser 32, through the blower 34, through the heating portion 36 to be heated to become drying air, and then through the drying air conduit 38 to enter the treating chamber 18 through the treating chamber air inlet 58. However, while the blower 34 is illustrated herein as being provided in between the condenser 32 and the heating portion 36, and specifically downstream of the condenser 32 and upstream of the heating portion 36, it will be understood that the blower 34 can be provided at any suitable location within the drying air circuit 60 so as to drive the supply of air along the drying air flow pathway 30. By way of non-limiting example, the blower 34 can be provided between the treating chamber air outlet 59 and the condenser 32 or between the heating portion 36 and the treating chamber air inlet 58. Further, while the closed loop drying air circuit 60 is illustrated herein as including both the condenser 32 and the heating portion 36, it will be understood that the closed loop drying air circuit 60 could also include the condenser 32, but not the heating portion 36, or could include the heating portion 36, but not the condenser 32.

When the drying air circuit 60 is provided as an open loop drying air circuit 60, the condenser 32 is not necessary. Alternatively, the blower 34, instead of being fluidly coupled with the condenser 32, can be fluidly coupled with an ambient air source, which can draw ambient air either from within the cabinet 12 or from the exterior of the cabinet 12. The ambient air can be provided from the blower 34 to the heating portion 36 to be heated to be provided through the drying air conduit 38 to enter the treating chamber 18 through the treating chamber air inlet 58. Air that flows through the treating chamber 18 and gathers moisture from the laundry items within the treating chamber 18, and is then exhausted through the treating chamber air outlet 59 and can be exhausted to the exterior of the cabinet 12. As the drying air is not being recirculated to the treating chamber 18, no condensing is necessary. In such an example, while the blower 34 is illustrated as being provided upstream of the heating portion 36, it will also be understood that the blower 34 can be provided between the heating portion 36 and the treating chamber air inlet 58. Additionally or alternatively, the same blower 34 or an additional blower 34 can be provided downstream of the treating chamber air outlet 59 to draw the exhaust air out of the treating chamber 18.

The laundry treating appliance 10 also includes a control assembly for controlling the operation of the laundry treating appliance 10 and its various working components to control the operation of the working components and to implement one or more treating cycles of operation. The control assembly can include a controller 96 located within the cabinet 12 and a user interface 98 that is operably coupled with the controller 96. The user interface 98 can provide input and output functions for the controller 96. In one example, the user interface 98 can be provided or integrated with the door assembly 24. In another example, as shown, the user interface 98 can be provided on a front panel of the cabinet 12.

The user interface 98 can include one or more knobs, dials, switches, displays, touch screens and the like for communicating with the user, such as to receive input and provide output. For example, the displays can include any suitable communication technology including that of a liquid crystal display (LCD), a light-emitting diode (LED) array, or any suitable display that can convey a message to the user. The user can enter different types of information including, without limitation, cycle selection (e.g., a washing cycle, a drying cycle, etc.) and cycle parameters, such as cycle options. Other communications paths and methods can also be included in the laundry treating appliance 10 and can allow the controller 96 to communicate with the user in a variety of ways. For example, the controller 96 can be configured to send a text message to the user, send an electronic mail to the user, or provide audio information to the user either through the laundry treating appliance 10 or utilizing another device such as a mobile phone.

The controller 96 can include the machine controller and any additional controllers provided for controlling any of the components of the laundry treating appliance 10. For example, the controller 96 can include the machine controller and a motor controller. Many known types of controllers can be used for the controller 96. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

Figure 2:
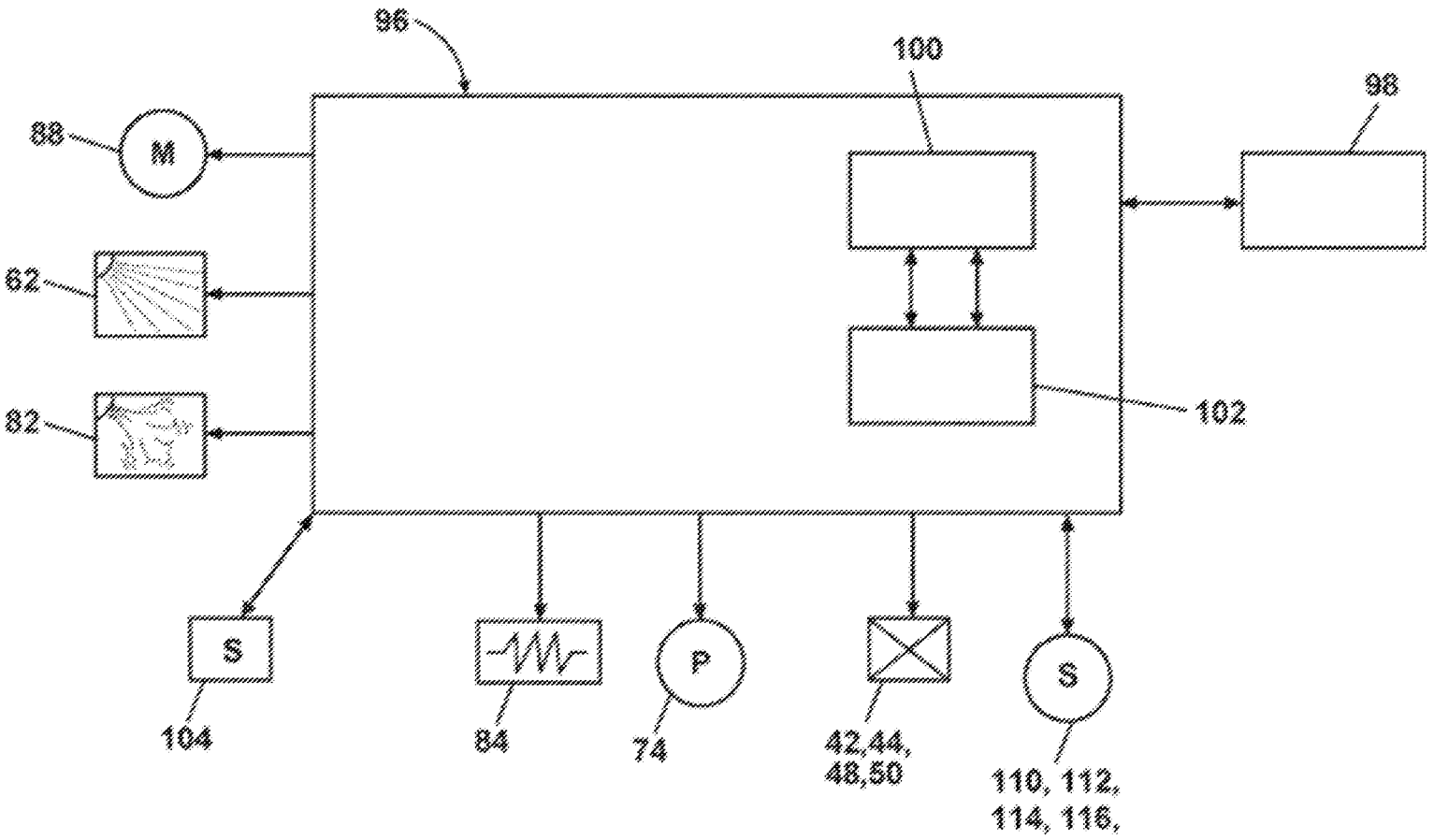
FIG. 2 illustrates a schematic of a control assembly of the laundry treating appliance.

As illustrated in FIG. 2, the controller 96 can be provided with a memory 100 and a central processing unit (CPU) 102. The memory 100 can be used for storing the control software that is executed by the CPU 102 in completing a cycle of operation using the laundry treating appliance 10 and any additional software. For example, the memory 100 can store a set of executable instructions including at least one user-selectable cycle of operation. Examples, without limitation, of cycles of operation include: wash, heavy duty wash, delicate wash, quick wash, pre-wash, refresh, rinse only, timed wash, dry, heavy duty dry, delicate dry, quick dry, or automatic dry, which can be selected at the user interface 98. The memory 100 can also be used to store information, such as a database or table, and to store data received from one or more components of the laundry treating appliance 10 that can be communicably coupled with the controller 96. The database or table can be used to store the various operating parameters for the one or more cycles of operation, including factory default values for the operating parameters and any adjustments to them by the control assembly or by user input.

The controller 96 can be operably coupled with one or more components of the laundry treating appliance 10 for communicating with and controlling the operation of the component to complete a cycle of operation. For example, the controller 96 can be operably coupled with the valves 42, 44 and the diverter mechanisms 48, 50 for controlling the temperature and flow rate of treating liquid into the treating chamber 18, the motor 88 for controlling the direction and speed of rotation of the drum 16, the pump 74 for controlling the amount of treating liquid in the treating chamber 18 or sump 70, the treating chemistry dispenser 62 for controlling the flow of treating chemistries into the treating chamber 18, the user interface 98 for receiving user selected inputs and communicating information to the user, the steam generator 82, the sump heater 84, and the drying air circuit 60, including the blower 34 and the heating portion 36, to control the operation of these and other components to implement one or more of the cycles of operation.

The controller 96 can also be coupled with one or more sensors 104 provided in one or more of the assemblies of the laundry treating appliance 10 to receive input from the sensors 104, which are known in the art and not shown for simplicity. Non-limiting examples of sensors 104 that can be communicably coupled with the controller 96 include: a treating chamber temperature sensor, such as a thermistor, which can detect the temperature of the treating liquid in the treating chamber 18 and/or the temperature of the treating liquid being supplied to the treating chamber 18, a moisture sensor, a weight sensor, a chemical sensor, a position sensor, an imbalance sensor, a load size sensor, and a motor torque sensor, which can be used to determine a variety of assembly and laundry characteristics, such as laundry load inertia or mass. In one example, a characteristic that can be determined by the controller 96 based on input from sensors 104 can include an estimated or assumed air flow rate or mass flow level through the drying air circuit 60 and/or through the treating chamber 18.

In one specific example, the laundry treating appliance 10 can include a first temperature sensor 110, a second temperature sensor 112, a first humidity sensor 114, and optionally a second humidity sensor 116, all of which are operably and communicably coupled with the controller 96 for use in determining an evaporation rate of moisture remaining in the laundry load, a dryness level of the laundry load, and an estimated remaining drying time for the laundry load. These sensors 110, 112, 114, 116 can be provided at a variety of locations within the laundry treating appliance 10, as will be discussed further. Depending on the location of the sensors 110, 112, 114, 116, it may be beneficial to provide structures to protect the sensors 110, 112, 114, 116 from the environment of the laundry treating appliance 10, such as shields or doors to protect from liquid, or mesh screens to protect from lint.

While illustrated as one controller, the controller 96 may be part of a larger control system and may be controlled by various other controllers throughout the laundry treating appliance 10. It should therefore be understood that the controller 96 and one or more other controllers can collectively be referred to as a "controller" that controls various components of the laundry treating appliance 10 in response to signals from the user interface 98 and/or the various sensors 104. The controller 96 may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller 96.

Figure 3:
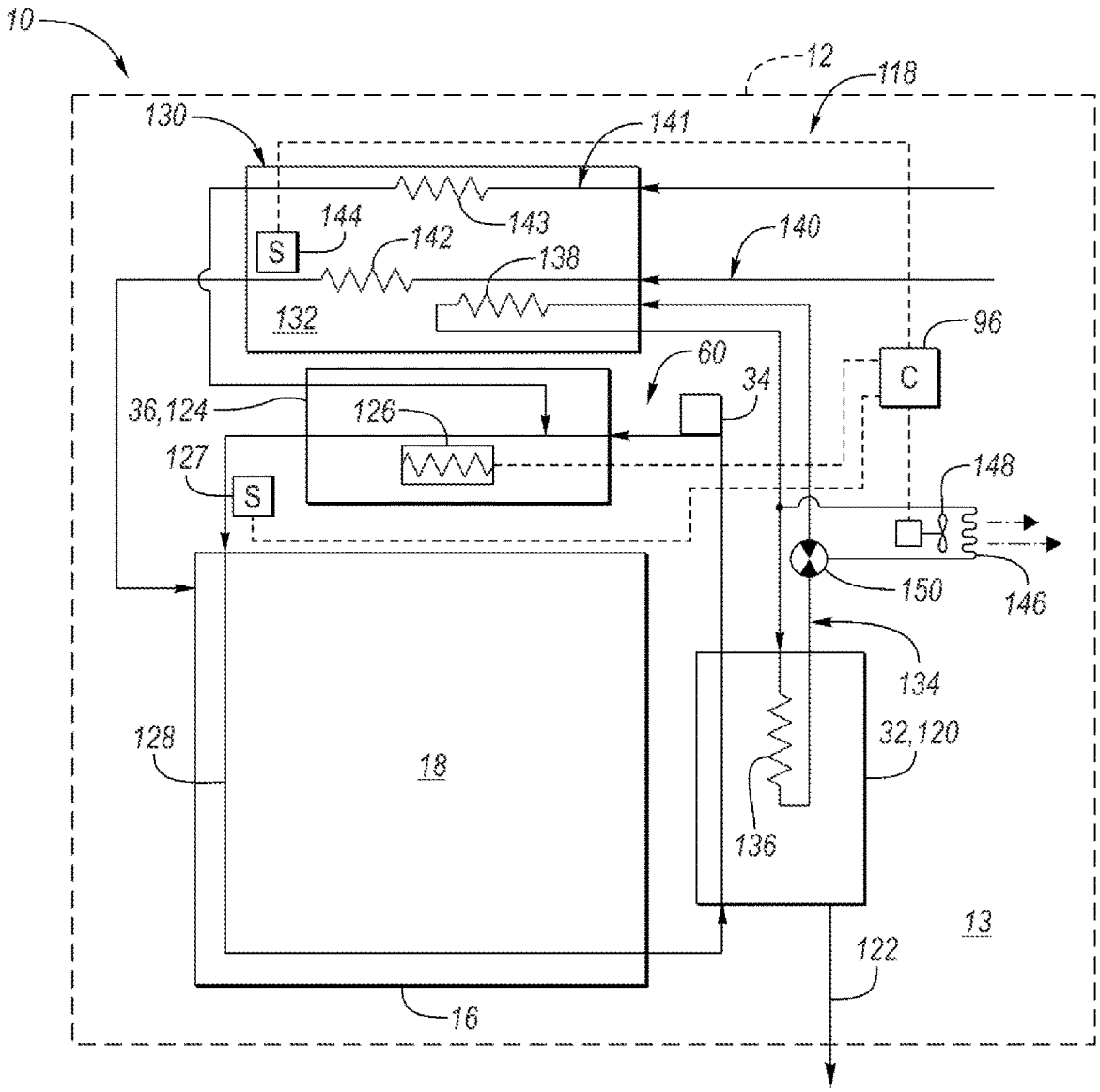
FIG. 3 is a schematic of a thermal energy recovery system of the laundry treating appliance.

Referring to FIG. 3, a thermal energy recovery system 118 of the laundry treating appliance 10 is illustrated. The thermal energy recovery system 118 may operate to recover and subsequently reuse heat that is typically lost from the drying air circuit 60 during a drying cycle, which increases the energy efficiency of the laundry treating appliance 10. The components of the thermal energy recovery system 118 may be disposed within the internal chamber 13 that is defined by the cabinet 12. The heating portion 36 and the condenser 32 may be part of an air duct system that forms a portion of the drying air circuit 60. More specifically, the condenser 32 may be an air duct 120 that operates to remove moisture from the warm and moist air exiting the laundry treating chamber 18 during a drying cycle. The air duct 120 may be at a lower temperature than the warm and moist air exiting the laundry treating chamber 18 resulting in condensation collecting within the air duct 120. The air exiting the air duct 120 is then dryer than the air entering the air duct 120 from the laundry treating chamber 18. A drain line 122 may be configured to direct the condensation collected in the air duct 120 to a drain system (e.g., the pump 74 and the drain conduit 76).

The dried air flowing out of the air duct 120 is then directed into air duct 124, which may form the heating portion 60. The air is then heated by a heater 126 (e.g., an electric heater) that is disposed within air duct 124. The heater 126 may be in communication with and controlled by the controller 96. The controller 96 may activate the heater 126 during a drying cycle and may control the operation of the heater 126 via a feedback control system based a temperature of the air flowing in the drying air circuit 60. The temperature of the air flowing within the drying air circuit 60 may be communicated to the controller 96 via temperature sensor 127. The heated air then enters the laundry treating chamber 18 to dry clothing articles within the laundry treating chamber 18 during the drying cycle, where the air collects moisture from the clothing articles. The warm and moist air exits the laundry treating chamber 18 and returns to air duct 120, where the process repeats. The circuit of air flow during a drying cycle is illustrated by the series of arrows 128. Air ducts 120, 124 are collectively configured to direct the air from the laundry treating chamber 18 to the heater 126 and from the heater 126 back to the laundry treating chamber 18 during the drying cycle.

The thermal energy recovery system 118 includes a vessel or container 130 having a heat storing or energy storage material 132 disposed therein. The energy storage material 132 may be any material that is capable of storing thermal energy for an extended period of time. The energy storage material 132 may be, but is not limited to, water, glycol, a refrigerant, or any suitable phase change material (i.e., a substance which releases or absorbs sufficient energy at phase transition to provide useful heating or cooling). The thermal energy recovery system 118 further includes a first fluid loop or fluid circuit 134 that is configured to transfer heat from the air flowing through air duct 120 to the energy storage material 132 during the drying cycle. The first fluid circuit 134 may be a sealed closed loop system the contains a fluid, such as water or glycol, that may efficiency transfer heat from the air flowing through air duct 120 to the energy storage material 132. More specifically, the heat is transferred from the air flowing through air duct 120 to the fluid in the first fluid circuit 134, and then the heat is transferred from the fluid in the first fluid circuit 134 to the energy storage material 132. Flow within the first fluid circuit 134 may occur naturally by convection once the heat is transferred from the air flowing through air duct 120 to the fluid in the first fluid circuit 134. Alternatively, a pump may be utilized to control the flow of the fluid through the first fluid circuit 134. Such a pump may be in communication with and controlled by controller 96.

A first heat exchanger 136 is disposed in air duct 120 and is configured to transfer heat from the air flowing through air duct 120 to the fluid in the first fluid circuit 134. A second heat exchanger 138 is disposed within container 130 and is configured to transfer heat from the fluid in the first fluid circuit 134 to the energy storage material 132. The first heat exchanger 136 and the second heat exchanger 138 may be tube and fin heat exchangers with the fluid in the first fluid circuit 134 flowing through the tube portions of the tube and fin heat exchangers. However, the first heat exchanger 136 and the second heat exchanger 138 may be any suitable type of heat exchanger.

A second fluid loop or fluid circuit 140 is configured to deliver water to the container 130 and to the energy storage material 132 such that the water is heated by the energy storage material 132. A third heat exchanger 142 is configured to transfer heat from the energy storage material 132 to the water flowing through the second circuit 140. The third heat exchanger 142 may be a tube and fin heat exchanger as well with the fluid in the second circuit 140 flowing through the tube portions of the tube and fin heat exchanger. However, the third heat exchanger 142 may be any suitable type of heat exchanger. The heated water is then delivered to the laundry treating chamber 18 during a washing cycle that is subsequent to a drying cycle. The second fluid circuit 140 may be an open loop system and may more specifically be fed by or an extension of the household water supply 40. The fluid within the second fluid circuit 140, however, may be sealed from the energy storage material 132 when flowing through the container 130 such that the fluid in second fluid circuit 140 does not mix with the energy storage material 132.

The controller 96 may be configured to adjust the amount of cold and hot water being supplied (e.g., by adjusting positions of valves 42, 44) based on a selected water temperature for a washing cycle. The ratio of hot water to cold water being supplied to the laundry treating appliance 10 may be adjusted based on an expected amount of heat that will be transferred to the water in the second fluid circuit 140 from the energy storage material 132. The expected amount of heat being transferred may be based on the temperature of the energy storage material 132, which may be communicated to the controller 96 via temperature sensor 144. The energy from previous drying cycles is thereby recovered during the subsequent washing cycle increasing the efficiency of the laundry treating appliance 10.

A third fluid loop or fluid circuit 141 is configured to deliver air to the container 130 and to the energy storage material 132 such that the air is heated by the energy storage material 132. A heat exchanger 143 is configured to transfer heat from the energy storage material 132 to the air flowing through the third fluid circuit 141. The heat exchanger 143 may be a tube and fin heat exchanger as well with the fluid (i.e., air) in the third fluid circuit 141 flowing through the tube portions of the tube and fin heat exchanger. However, the heat exchanger 143 may be any suitable type of heat exchanger. The heated air may then be delivered to the heating portion 36 during the current drying cycle allowing for the immediate use of the energy being stored within the energy storage material 132. The third fluid circuit 141 may be an open loop system. More specifically a fan having a motor (e.g., see fan 148) may direct the ambient air into the be third fluid circuit 141. The fluid within the third fluid circuit 141, however, may be sealed from the energy storage material 132 when flowing through the container 130 such that the fluid in third fluid circuit 141 does not mix with the energy storage material 132. The warm air leaving the container 130 will enter into the drying air circuit 60 before reaching the heater 126. This results in the air from the third fluid circuit 141 mixing with the air exiting the condenser 32, resulting in lowering the humidity of the air being directed to the heater 126, increasing the temperature of the air being directed to the heater 126, and reducing the required power output of the heater 126.

It may be desirable to set an upper temperature limit or threshold for the energy storage material 132 due to capacity limits of the energy storage material 132 to retain thermal energy or to prevent the storage of excessive heat in the laundry treating appliance 10. A fourth heat exchanger 146 may be configured to transfer heat from the fluid disposed within the first fluid circuit 134 to the ambient air. The fourth heat exchanger 146 may be a tube and fin heat exchanger as well with the fluid in the first circuit 134 flowing through the tube portions of the tube and fin heat exchanger. However, the fourth heat exchanger 146 may be any suitable type of heat exchanger. The fourth heat exchanger 146 may be connected to a secondary portion of the first fluid circuit 134 that branches from a primary portion of the first fluid circuit 134, where the primary portion of the first fluid circuit 134 is connected to the second heat exchanger 138. A fan 148 (e.g., an electric fan powered by an electric motor) may be configured to direct air across the fourth heat exchanger 146 to transfer heat from the fluid disposed within the first fluid circuit 134 to the ambient air. The fan 148 may be in communication with and controlled by the controller 96. More specially, an actuator, such as an electric motor, that powers the fan 148 may be in communication with and controlled by the controller 96.

A valve 150 may be connected to the first fluid circuit 134. The valve 150 may be configured to (i) direct the fluid in the first fluid circuit 134 to the second heat exchanger 138 and (ii) isolate the fluid in the first fluid circuit 134 from the fourth heat exchanger 146 when in a first position and when it is desirable to transfer heat to the energy storage material 132 for storage. The valve 150 may also be configured to (i) direct the fluid in the first fluid circuit 134 to the fourth heat exchanger 146 and (ii) isolate the fluid in the first fluid circuit 134 from the second heat exchanger 138 when in a second position and when it is not desirable to transfer heat to the energy storage material 132 for storage. The valve 150 may be in communication with and controlled by the controller 96. More specially, an actuator, such as an electric solenoid, that transitions the valve 150 between positions may be in communication with and controlled by the controller 96.

Figure 4:
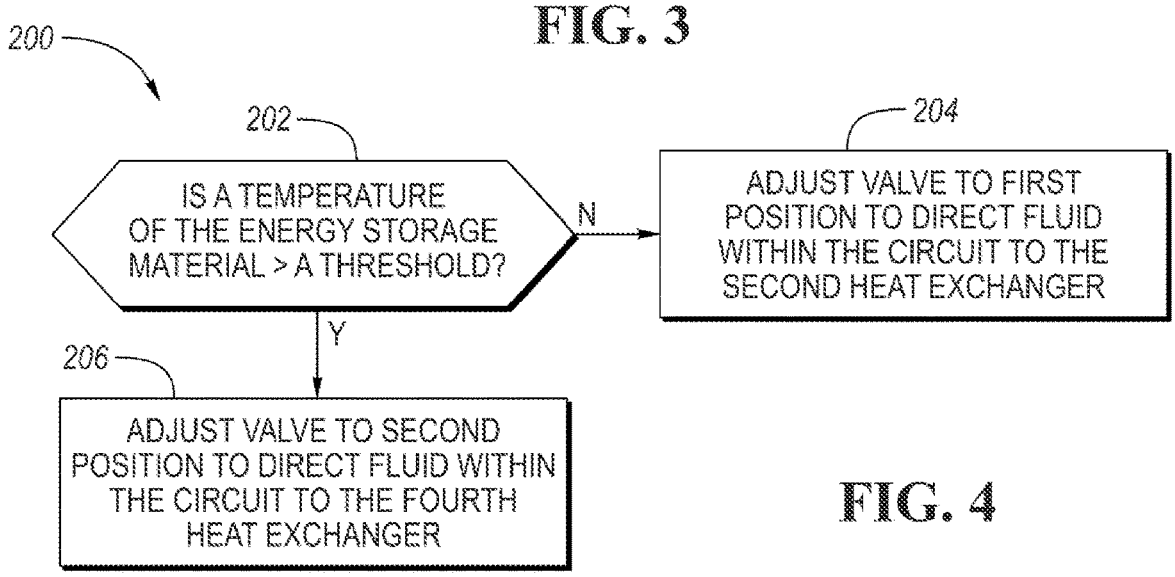
FIG. 4 is a method of controlling the thermal energy recovery system.

Referring to FIG. 4, a flowchart illustrating a method 200 for controlling the thermal energy recovery system 118 is illustrated. The method 200 may be implemented by the controller 96. The method 200 may be stored as control logic and/or algorithms within the controller 96. The controller 96 may be configured to control the operation of various components of the thermal energy recovery system 118 in response to various commands received by the controller 96. The method 200 begins at block 202 where it is determined if the temperature of the energy storage material 132 is greater than a threshold. If the temperature of the energy storage material 132 is less than the threshold, the method 200 moves on to block 204 where the valve 150 is maintained or transitioned to the first position to direct the fluid in the first fluid circuit 134 to the second heat exchanger 138 and isolate the fluid in the first fluid circuit 134 from the fourth heat exchanger 146 so that additional thermal energy may be stored in the energy storage material 132. If the temperature of the energy storage material 132 is greater than the threshold, the method 200 moves on to block 206 where the valve 150 is maintained or transitioned to the second position to direct the fluid in the first fluid circuit 134 to the fourth heat exchanger 146 and isolate the fluid in the first fluid circuit 134 from the second heat exchanger 138 so that additional thermal energy is not stored in the energy storage material 132. The method 200 may include a hysteresis in the temperature of the energy storage material 132 for transitioning the valve 150 between the first and second positions. It should be understood that the flowchart in FIG. 4 is for illustrative purposes only and that the method 200 should not be construed as limited to the flowchart in FIG. 4. Some of the steps of the method 200 may be rearranged while others may be omitted entirely.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A laundry machine washer-dryer combination comprising:

a cabinet defining an internal chamber;

a drum (i) disposed in the internal chamber and (ii) configured to receive clothing articles;

a heater (i) disposed in the internal chamber and (ii) configured to heat air flowing to the drum during a drying cycle;

an air duct (i) disposed in the internal chamber and (ii) configured direct air from the drum to the to the heater during the drying cycle;

a container (i) disposed in the internal chamber and (ii) having an energy storage material disposed therein;

a fluid loop configured to transfer heat from the air flowing through the air duct to the energy storage material during the drying cycle;

a first heat exchanger (i) disposed in the air duct and (ii) configured to transfer heat from the air flowing through the air duct to a fluid disposed within the fluid loop;

a second heat exchanger configured to transfer heat from the fluid disposed within the fluid loop to the energy storage material;

a third heat exchanger configured to transfer heat from the fluid disposed within the fluid loop to ambient air; and a valve configured to (i) direct the fluid in the fluid loop to the second heat exchanger in a first position (ii) isolate the fluid in the fluid loop from the third heat exchanger in the first position (iii) direct the fluid in the fluid loop to the third heat exchanger in a second position, and (iv) isolate the fluid in the fluid loop from the second heat exchanger in the second position; and a controller programmed to, in response to a temperature of energy storage material being less than a threshold, maintain or transition the valve in or to the first position, and in response to the temperature of energy storage material being greater than the threshold, maintain or transition the valve in or to the second position.

2. The laundry machine washer-dryer combination of claim 1 further comprising a second fluid loop configured to (i) deliver water to the energy storage material such that the water is heated by the energy storage material and (ii) deliver the heated water to the drum during a washing cycle.

3. The laundry machine washer-dryer combination of claim 2 further comprising a fourth heat exchanger configured to transfer heat from the energy storage material to the water flowing through the second fluid loop.

4. The laundry machine washer-dryer combination of claim 2, wherein (i) the fluid loop is a closed loop and (ii) the second fluid loop is an open loop.

5. A laundry machine comprising:

a drum configured to receive clothing articles;

a heater configured to heat air flowing to the drum;

an air duct configured direct air from the drum to the heater;

a storage vessel having an energy storage material disposed therein; and a fluid circuit having a fluid disposed therein, wherein the fluid circuit (i) is a sealed closed loop, (ii) extends into the air duct, and (iii) extends into the storage vessel, wherein the fluid is configured to (a) circulate through the fluid circuit, (b) receive heat from the air flowing through the air duct, and (c) transfer the heat inside of the storage vessel from the fluid to the energy storage material.

6. The laundry machine of claim 5 further comprising a heat exchanger (i) disposed within the air duct, (ii) connected to the fluid circuit, and (iii) configured to transfer heat from the air flowing through the air duct to the fluid disposed within the fluid circuit.

7. The laundry machine of claim 6 further comprising a second heat exchanger (i) disposed within the storage vessel, (ii) connected to the fluid circuit, (iii) engaging the energy storage material, and (iv) configured to transfer heat from the fluid disposed within the fluid circuit to the energy storage material.

8. The laundry machine of claim 7 further comprising:

a third heat exchanger configured to transfer heat from the fluid disposed within the fluid circuit to ambient air; and a valve configured to (i) direct the fluid in the fluid circuit to the second heat exchanger in a first position (ii) isolate the fluid in the fluid circuit from the third heat exchanger in the first position (iii) direct the fluid in the fluid circuit to the third heat exchanger in a second position, and (iv) isolate the fluid in the fluid circuit from the second heat exchanger in the second position; and a controller programmed to, in response to a temperature of energy storage material being less than a threshold, maintain or transition the valve in or to the first position, and in response to the temperature of energy storage material being greater than the threshold, maintain or transition the valve in or to the second position.

9. The laundry machine of claim 5 further comprising a second fluid circuit configured to (i) deliver a second fluid to the storage vessel such that the second fluid is heated by the energy storage material and (ii) deliver the heated second fluid into the drum.

10. The laundry machine of claim 9 further comprising a heat exchanger disposed within the storage vessel and configured to transfer heat from the energy storage material to the second fluid flowing through the second fluid circuit.

11. The laundry machine of claim 10, wherein the second fluid is water, and wherein the second fluid circuit is configured to (i) deliver the water to the storage vessel such that the water is heated by the energy storage material and (ii) deliver the heated water into the drum during a washing cycle.

12. The laundry machine of claim 10, wherein the second fluid is air, and wherein the second fluid circuit is configured to (i) deliver the air to the storage vessel such that the air is heated by the energy storage material and (ii) deliver the heated air into the drum during a drying cycle.

13. A laundry machine comprising:

a cabinet defining a laundry treating chamber;

a heater configured to heat air flowing to the laundry treating chamber;

an air duct configured direct air from the laundry treating chamber to the heater;

a storage vessel having a heat storing material disposed therein, wherein the storage vessel is disposed within the cabinet; and a fluid circuit having a fluid disposed therein, wherein the fluid circuit (i) is a sealed closed loop, (ii) extends into the air duct, and (iii) extends into the storage vessel, wherein the fluid is configured to (a) circulate through the fluid circuit, (b) receive heat from the air flowing through the air duct, and (c) transfer the heat inside of the storage vessel from the fluid to the heat storing material.

14. The laundry machine of claim 13 further comprising a heat exchanger (i) disposed within the air duct, (ii) connected to the fluid circuit, and (iii) configured to transfer heat from the air flowing through the air duct to the fluid disposed within the fluid circuit.

15. The laundry machine of claim 14 further comprising a second heat exchanger (i) disposed within the storage vessel, (ii) connected to the fluid circuit, (iii) engaging the heat storing material, and (iv) configured to transfer heat from the fluid disposed within the fluid circuit to the heat storing material.

16. The laundry machine of claim 15 further comprising:

a third heat exchanger configured to transfer heat from the fluid disposed within the fluid circuit to ambient air; and a valve configured to (i) direct the fluid in the fluid circuit to the second heat exchanger in a first position (ii) isolate the fluid in the fluid circuit from the third heat exchanger in the first position (iii) direct the fluid in the fluid circuit to the third heat exchanger in a second position, and (iv) isolate the fluid in the fluid circuit from the second heat exchanger in the second position; and a controller programmed to, in response to a temperature of heat storing material being less than a threshold, maintain or transition the valve in or to the first position, and in response to the temperature of heat storing material being greater than the threshold, maintain or transition the valve in or to the second position.

17. The laundry machine of claim 13 further comprising a second fluid circuit configured to (i) deliver a second fluid to the storage vessel such that the second fluid is heated by the heat storing material and (ii) deliver the heated second fluid into the laundry treating chamber.

18. The laundry machine of claim 17 further comprising a heat exchanger disposed with the storage vessel and configured to transfer heat from the heat storing material to the second fluid flowing through the second fluid circuit.

19. The laundry machine of claim 17, wherein the second fluid is water, and wherein the second fluid circuit is configured to (i) deliver the water to the storage vessel such that the water is heated by the heat storing material and (ii) deliver the heated water into the drum during a washing cycle.

20. The laundry machine of claim 17, wherein the second fluid is air, and wherein the second fluid circuit is configured to (i) deliver the air to the storage vessel such that the air is heated by the heat storing material and (ii) deliver the heated air into the drum during a drying cycle.

* * * * *